US009371120B2

(12) United States Patent
Williams, Jr.

(10) Patent No.: US 9,371,120 B2
(45) Date of Patent: Jun. 21, 2016

(54) FLOTATION ASSISTANCE BELT

(71) Applicant: Haywood Williams, Jr., Plano, TX (US)

(72) Inventor: Haywood Williams, Jr., Plano, TX (US)

( * ) Notice: Subject to any disclaimer, the term of this patent is extended or adjusted under 35 U.S.C. 154(b) by 24 days.

(21) Appl. No.: 14/321,599

(22) Filed: Jul. 1, 2014

(65) Prior Publication Data

US 2015/0011135 A1 Jan. 8, 2015

Related U.S. Application Data

(60) Provisional application No. 61/842,387, filed on Jul. 3, 2013.

(51) Int. Cl.
*B63C 9/08* (2006.01)
*B63C 9/13* (2006.01)

(52) U.S. Cl.
CPC .. *B63C 9/13* (2013.01); *B63C 9/082* (2013.01)

(58) Field of Classification Search
CPC ..... B63C 9/00; B63C 9/08; B63C 9/082; B63C 9/093; B63C 9/13; B63C 9/135; B63C 2009/00; B63C 2009/08; B63C 2009/13
USPC ..... 441/80, 88, 106, 108, 113, 129, 131, 441/132
See application file for complete search history.

(56) References Cited

U.S. PATENT DOCUMENTS 1,251,394 A * 12/1917 Lyon ..... B63C 9/155 441/111
2,145,289 A * 1/1939 Boudreaux ..... B63C 9/155 160/DIG. 7
4,379,705 A * 4/1983 Saotome ..... B63C 9/155 441/108
4,626,221 A * 12/1986 Rocco ..... B63C 9/155 441/108
5,022,879 A * 6/1991 DiForte ..... B63C 9/135 441/108
5,037,341 A * 8/1991 Howard ..... B63C 9/1255 441/106
5,143,057 A * 9/1992 DePasquale ..... A61H 7/001 482/131
5,178,569 A * 1/1993 Wang ..... B63C 9/18 441/106
5,180,321 A * 1/1993 Brown ..... B63C 9/155 441/108
5,348,504 A * 9/1994 Pierce ..... B63C 9/155 441/108
5,368,512 A * 11/1994 Brown ..... B63C 9/155 441/108
5,382,184 A * 1/1995 DiForte, Jr. ..... B63C 9/155 441/108

(Continued)

*Primary Examiner* — Daniel V Venne
(74) *Attorney, Agent, or Firm* — Plager Schack LLP

(57) ABSTRACT

A flotation assistance belt is configured to fit beneath arms of a human user in order to provide buoyancy to the human user in water. The flotation assistance belt includes a belt mechanically coupled to a female fastener and a male fastener. A flotation tube is partially surrounding the belt and configured to bend forming a circle without plastic deformation while having the tensile strength to resist this bending causing the flotation tube to expand outward slightly when the female fastener and the male fastener are connected. Connecting the female fastener to the male fastener forms a circle configured to fit beneath the arms of the human user in order to provide the buoyancy to the human user in the water.

1 Claim, 4 Drawing Sheets

(56) References Cited

U.S. PATENT DOCUMENTS 5,393,254 A * 2/1995 Ducheshe ..... B63C 9/1255 441/108
5,669,795 A * 9/1997 Lahtinen ..... B63C 9/155 441/117
5,702,279 A * 12/1997 Brown ..... B63C 9/155 441/108
5,839,932 A * 11/1998 Pierce ..... B63C 9/26 441/80
6,036,562 A * 3/2000 Brown ..... B63C 9/155 441/108
6,106,348 A * 8/2000 Loisel ..... B63C 9/155 441/108
6,231,411 B1 * 5/2001 Vinay ..... A41D 7/003 441/120
6,389,605 B2 * 5/2002 Srivastava ..... A41F 1/00 2/311
6,394,866 B1 * 5/2002 Brown ..... B63C 9/1255 441/108
6,567,992 B2 * 5/2003 Ross ..... A41F 9/005 182/3
6,620,010 B2 * 9/2003 Noonan ..... B63C 9/1255 441/106
7,033,237 B2 * 4/2006 Spagnuolo ..... A47D 7/003 441/108
7,160,167 B2 * 1/2007 Peters ..... A01K 1/035 119/855
7,306,501 B2 * 12/2007 Pierce, Jr. ..... B63C 9/26 182/3
8,715,024 B2 * 5/2014 Westwood ..... B63C 9/155 441/106
8,951,082 B2 * 2/2015 Magnusson ..... B63C 9/155 441/108
2012/0225599 A1 * 9/2012 Koersen ..... A63B 69/14 441/106

* cited by examiner

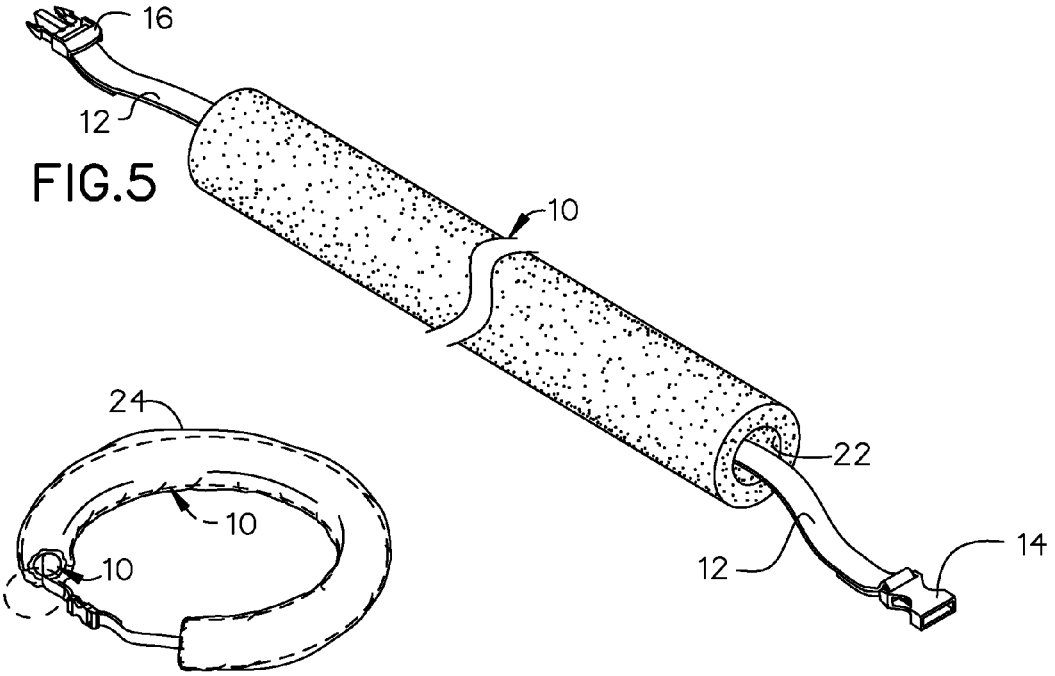
FIG.5
FIG.6
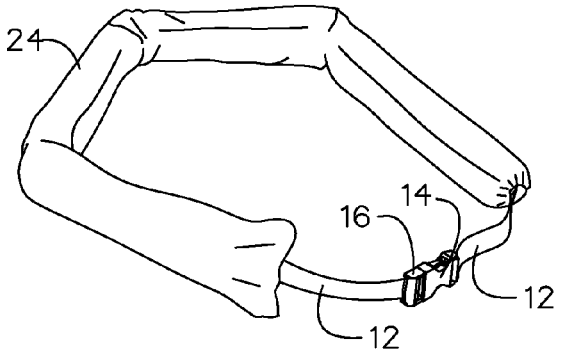
FIG.7
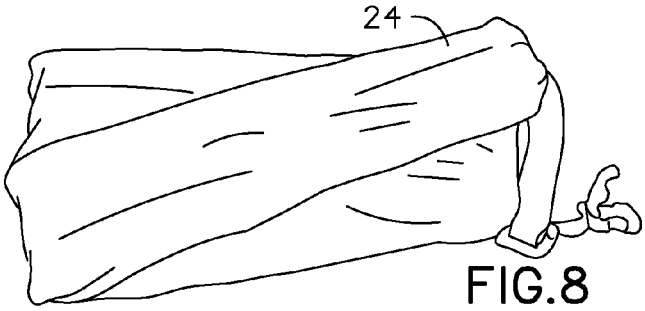
FIG.8

FLOTATION ASSISTANCE BELT

RELATED APPLICATION

This application claims priority to provisional patent application U.S. Ser. No. 61/842,387 filed on Jul. 3, 2013, the entire contents of which is herein incorporated by reference.

BACKGROUND

The embodiments herein relate generally to flotation devices.

Prior to embodiments of the disclosed invention, life jackets were bulky and uncomfortable. Pool noodles did not stay on a user's body and easily slipped away. Embodiments of the disclosed invention solve these problems.

SUMMARY

A flotation assistance belt is configured to fit beneath arms of a human user in order to provide buoyancy to the human user in water. The flotation assistance belt includes a belt mechanically coupled to a female fastener and a male fastener. A flotation tube is partially surrounding the belt and configured to bend forming a circle without plastic deformation while having the tensile strength to resist this bending causing the flotation tube to expand outward slightly when the female fastener and the male fastener are connected. Connecting the female fastener to the male fastener forms a circle configured to fit beneath the arms of the human user in order to provide the buoyancy to the human user in the water.

In some embodiments, the flotation assistance further comprises a jacket entirely surrounding the flotation tube. The flotation tube is fragmented to facilitate storage.

In some embodiments, the jacket further comprises an upper compartment and a lower compartment. The flotation tube is an upper flotation tube and is housed in the upper compartment. A lower flotation tube is housed in the lower compartment. Utilizing the upper flotation tube and the lower flotation tube creates additional buoyancy for the human user.

BRIEF DESCRIPTION OF THE FIGURES

The detailed description of some embodiments of the invention is made below with reference to the accompanying figures, wherein like numerals represent corresponding parts of the figures.

FIG. 5 is a perspective view of the invention shown in unrolled state.

FIG. 6 is a perspective view of an embodiment of the invention.

FIG. 7 is a perspective view of an embodiment of the invention.

FIG. 8 is a perspective view of an embodiment of the invention.

DETAILED DESCRIPTION OF CERTAIN EMBODIMENTS

Figure 1:
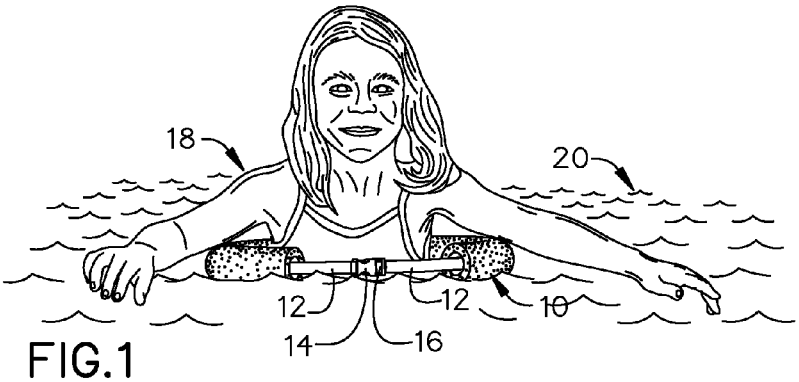
FIG. 1 is a perspective view of an embodiment of the invention shown in use.
Figure 2:
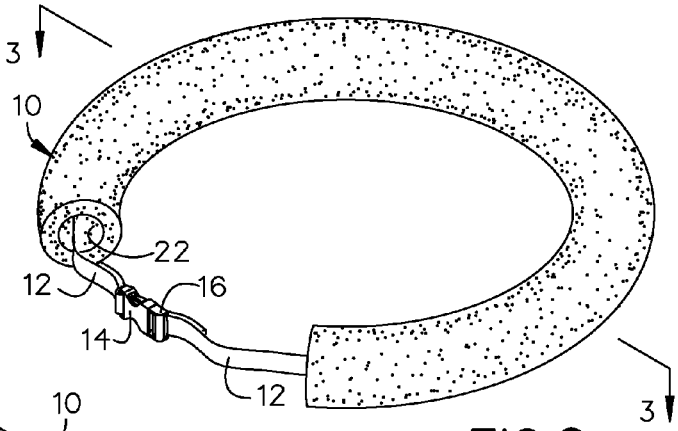
FIG. 2 is a perspective view of an embodiment of the invention.
Figure 3:
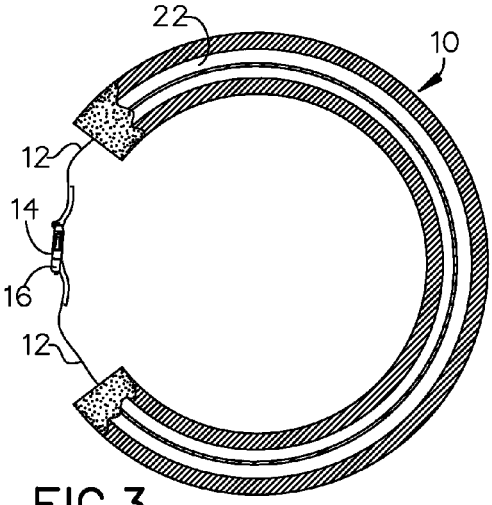
FIG. 3 is a top partial section view of an embodiment of the invention taking along line 3-3 in FIG. 2.
Figure 4:
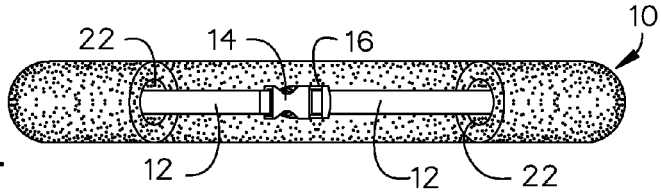
FIG. 4 is a front view of an embodiment of the invention.
Figure 9:
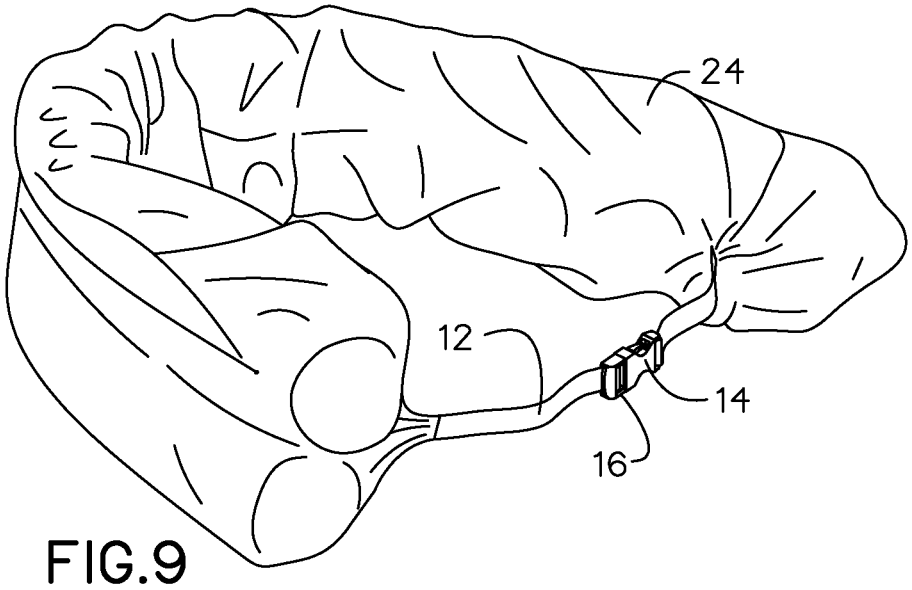
FIG. 9 is a perspective view of an embodiment of the invention.
Figure 10:
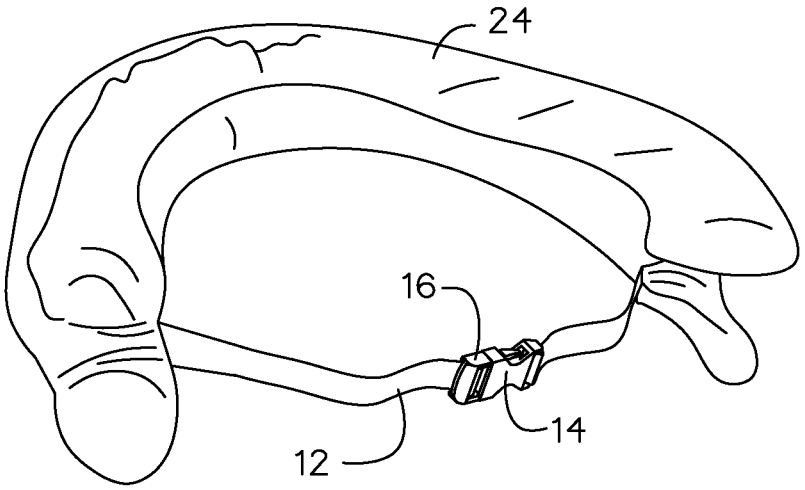
FIG. 10 is a perspective view of an embodiment of the invention.
Figure 11:
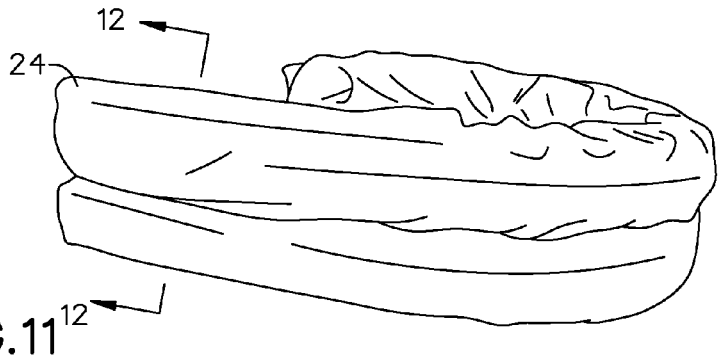
FIG. 11 is a perspective view of an embodiment of the invention.
Figure 12:
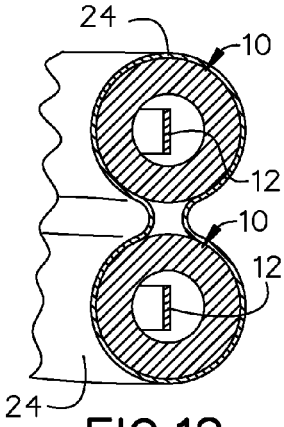
FIG. 12 is a section detail view of an embodiment of the invention along line 12-12 in FIG. 14.
Figure 13:
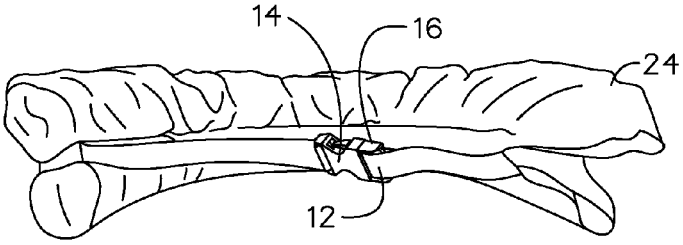
FIG. 13 is a perspective view of an embodiment of the invention.
Figure 14:
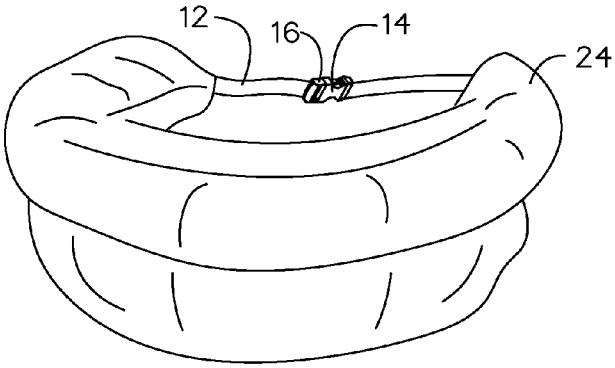
FIG. 14 is a perspective view of an embodiment of the invention.

By way of example, and referring to FIG. 1, human user 18 desires to stay afloat in water 20. Flotation assistance belt 10 can accomplish this.

FIG. 2, FIG. 3, FIG. 4 and FIG. 5 show that one embodiment of flotation assistance belt 10 comprises belt 12, mechanically coupled to female fastener 14 and male fastener 16. Belt 12 is threaded through flotation tube 22 such that female fastener 14 extends past a flotation tube first end and male fastener 16 extends past a flotation tube second end. To use the device, human user 18 simply wraps flotation assistance belt 10 beneath human arms and engages female fastener 14 to male fastener 16. Flotation tube 22 is configured to be flexible, such that it can bend as shown forming a circle without plastic deformation while having the tensile strength to slightly resist this bending causing flotation tube to expand outward slightly and with some rigidity when female fastener 14 and male fastener 16 are connected.

Turning to FIG. 6, FIG. 7 and FIG. 8, in some embodiments in may be necessary fragment flotation tube 22 for portability or to more comfortably fit underneath a human user's arms. When this is done, flotation tube 22 should be covered in jacket 24.

There is no requirement that jacket 24 can be limited to a single flotation tube 22. Rather, in some embodiments, it is preferable to use a second flotation tube 22 as shown in FIG. 9, FIG. 10, FIG. 11, FIG. 12, FIG. 13 and FIG. 14.

Here, jacket 24 is partitioned into an upper jacket compartment and a lower jacket compartment. The upper jacket compartment is filled with upper flotation tube 22, while the lower jacket compartment is filled with lower flotation tube 22. Upper flotation tube 22 is threaded with upper belt 12. Likewise, lower flotation tube 22 is threaded with lower belt 12. Upper belt 12 and lower belt 12 are mechanically coupled to outer belt 12 (shown in FIG. 13) which is mechanically coupled to female fastener 14 and male fastener 16.

The number of combinations of these components varies widely with a need for flotation of human user 18. Additional compartments can be added as needed to accommodate additional tubes.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A flotation assistance belt, configured to fit beneath arms of a human user in order to provide buoyancy to the human user in water; the flotation assistance belt comprising:

a belt, mechanically coupled to a female fastener and a male fastener;

a flotation tube, partially surrounding the belt and configured to bend forming a circle without plastic deformation while having tensile strength to resist bending causing the flotation tube to expand outward slightly when the female fastener and the male fastener are connected;

a jacket entirely surrounding the flotation tube;

wherein the jacket further comprises an upper compartment and a lower compartment;

wherein the flotation tube is an upper flotation tube and is housed in the upper compartment;

a lower flotation tube, housed in the lower compartment;

wherein utilizing the upper flotation tube and the lower flotation tube creates additional buoyancy for the human user;

wherein connecting the female fastener to the male fastener forms a circle configured to fit beneath the arms of the human user in order to provide the buoyancy to the human user in the water.

* * * * *